United States Patent [19]

Binder et al.

[11] Patent Number: 4,951,358

[45] Date of Patent: Aug. 28, 1990

[54] FLOCK DELIVERY SYSTEM

[75] Inventors: Rolf Binder, Schottikon; Daniel Hanselmann; Walter Schlepfer, both of Winterthur; Christoph Staeheli, Frauenfeld, all of Switzerland

[73] Assignee: Rieter Machine Works, Ltd., Winterthur, Switzerland

[21] Appl. No.: 474,209

[22] Filed: Feb. 1, 1990

Related U.S. Application Data

[63] Continuation of Ser. No. 352,692, May 4, 1989, abandoned, which is a continuation of Ser. No. 216,858, Jul. 8, 1988, abandoned, which is a continuation of Ser. No. 914,116, Oct. 1, 1986, abandoned.

[30] Foreign Application Priority Data

Oct. 2, 1985 [GB] United Kingdom ..... 8524304

[51] Int. Cl.[5] ..... D01B 1/48

[52] U.S. Cl. ..... 19/80 R; 19/81

[58] Field of Search ..... 19/80 R, 81, 145.5

[56] References Cited

U.S. PATENT DOCUMENTS

| | | | |
|---|---|---|---|
| 3,443,285 | 5/1969 | Goldammer et al. | 19/81 |
| 4,297,766 | 11/1981 | Trutzschler | 19/80 R |
| 4,363,585 | 12/1982 | Keller et al. | 19/80 R |
| 4,382,316 | 5/1983 | Goldammer et al. | 19/81 |
| 4,455,714 | 6/1984 | Goldammer et al. | 19/81 |
| 4,493,131 | 1/1985 | Dragagna et al. | 19/81 X |
| 4,513,479 | 4/1985 | Binder et al. | 19/81 X |
| 4,566,152 | 1/1986 | Zuend | 19/81 |
| 4,587,691 | 5/1966 | Hösel | 19/80 R |
| 4,660,257 | 4/1987 | Binder et al. | 19/80 R |

FOREIGN PATENT DOCUMENTS

| | | | |
|---|---|---|---|
| 0199041 | 10/1986 | European Pat. Off. | 19/80 R |
| 3335763 | 4/1985 | Fed. Rep. of Germany | 19/80 R |

*Primary Examiner*—Werner H. Schroeder
*Assistant Examiner*—Michael A. Neas
*Attorney, Agent, or Firm*—Kenyon & Kenyon

[57] ABSTRACT

The flock delivery system employs a microcomputer with a storage cell for each marker and a storage cell for each stretch of path (containing one or more bale groups) between the markers. The control system is conditional selectively to "permit" or "inhibit" extraction of flocks from bales in each block individually. Various flock bending combinations can be obtained from time-to-time by programming of the control system.

19 Claims, 4 Drawing Sheets

Fig. 1 PRIOR ART
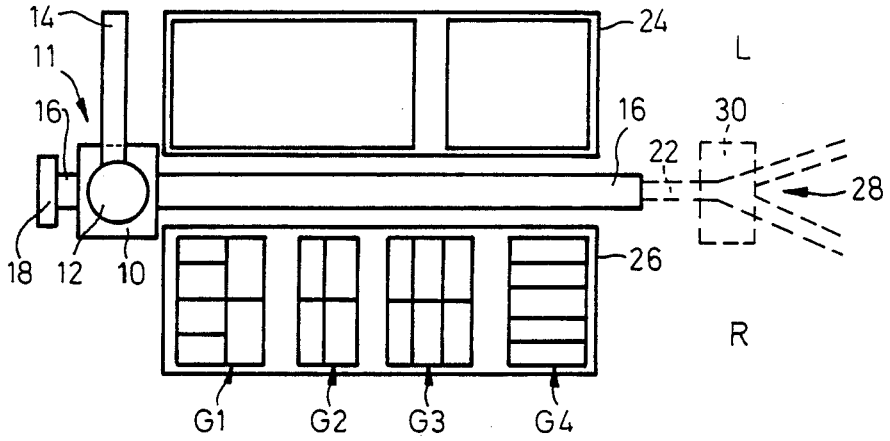
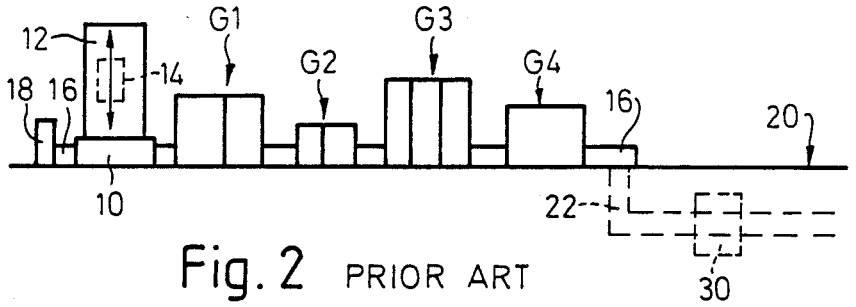
Fig. 2 PRIOR ART
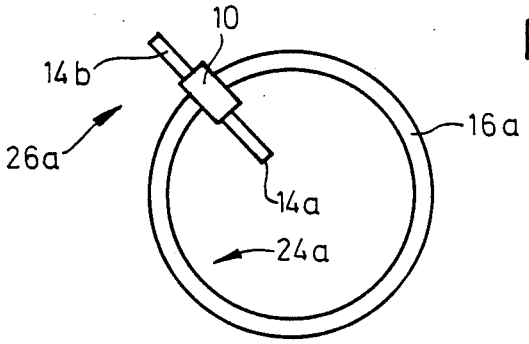
Fig. 3

Fig. 5
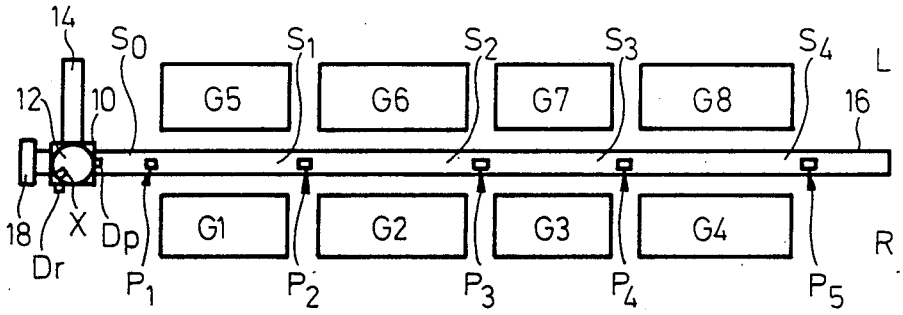
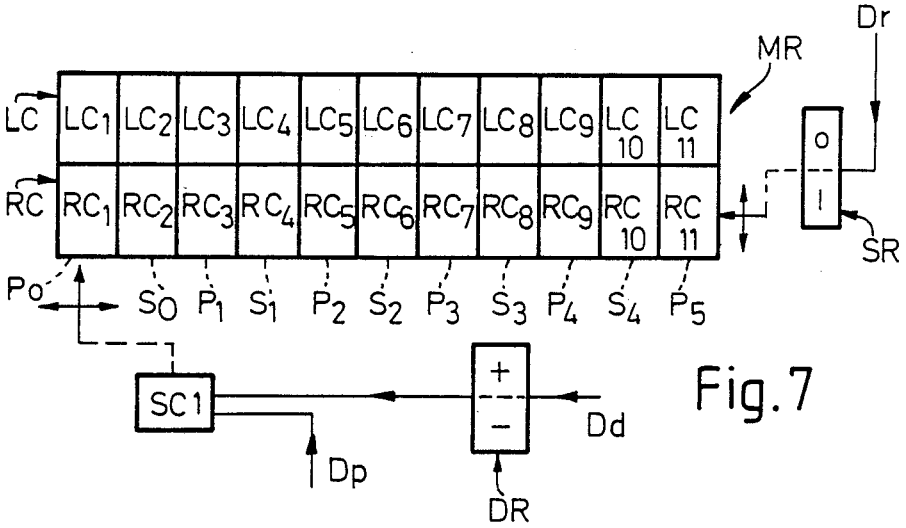
Fig. 7
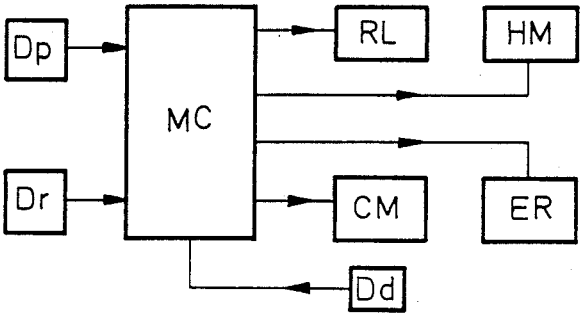
Fig. 6

Fig. 4
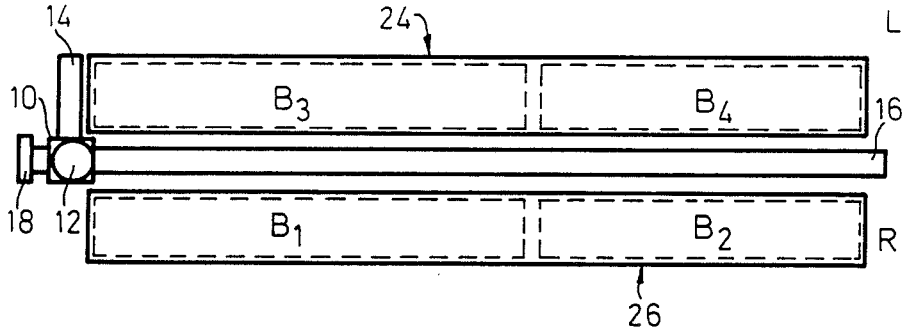
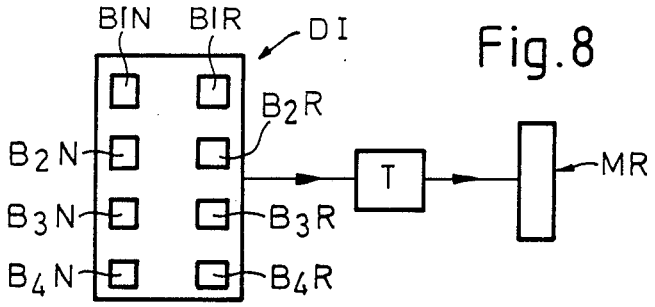
Fig. 8
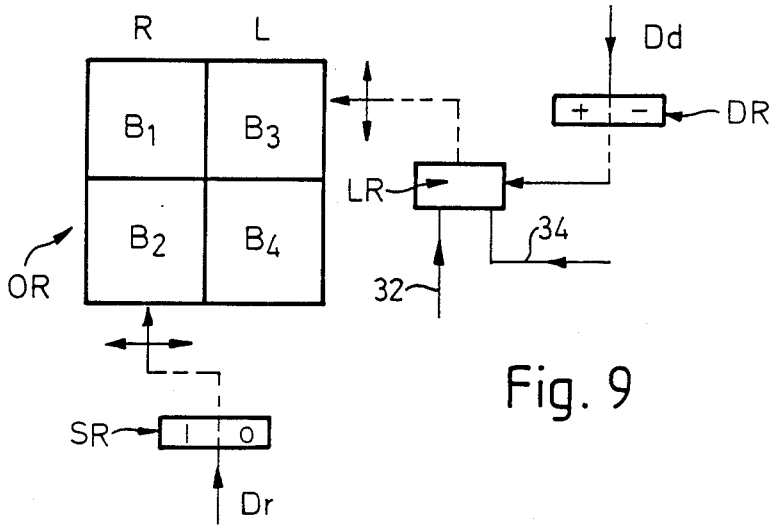
Fig. 9

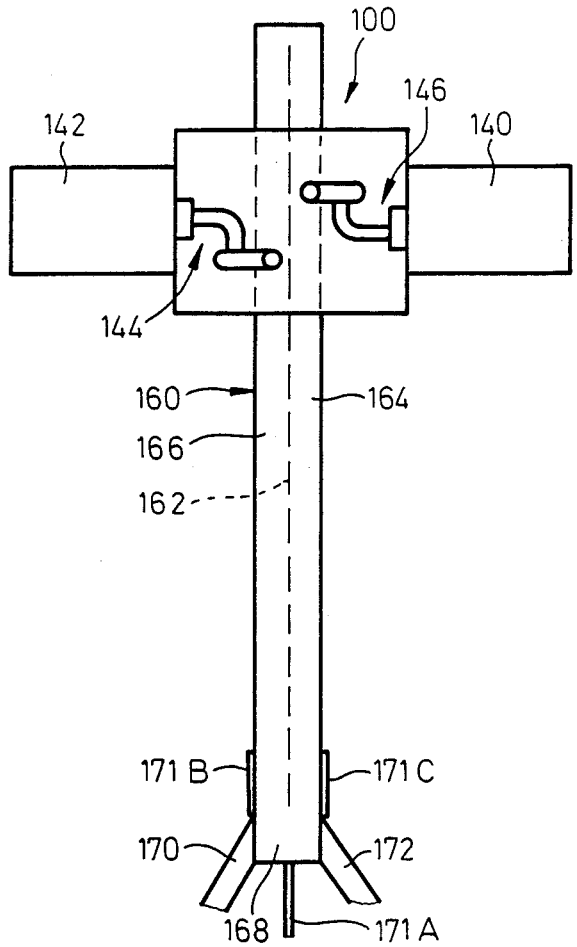
Fig.11
Fig.10
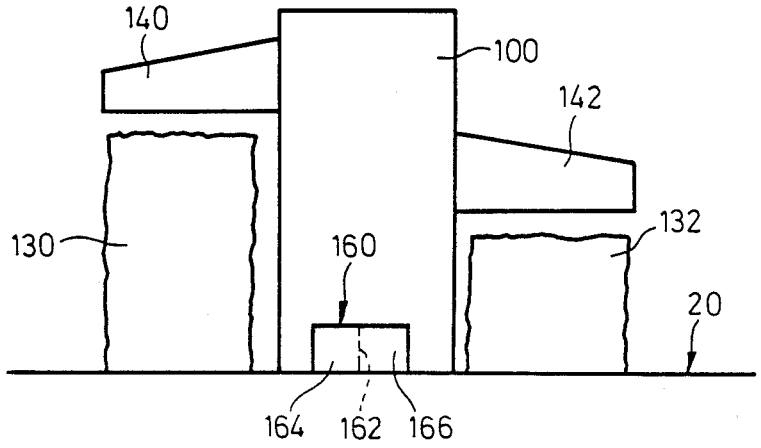

FLOCK DELIVERY SYSTEM

This is a continuation of Application Ser. No. 07/352,692, filed May 4, 1989, which is a continuation of 07/216,858, filed July 8, 1988 (now abandoned), which is a continuation of 06/914,116, filed Oct. 1, 1986 (now abandoned.

This invention relates to a flock delivery system. More particularly, this invention relates to a flock delivery system having a flock extraction unit which is movable relative to a "lay out" of fiber bales in order to extract flock material therefrom.

PRIOR ART

As is known, flock delivery systems which employ flock extraction units, for example the machine supplied by Rieter Machine Works, Ltd. under the trade mark UNIFLOC, have become increasingly common in spinning mills over the last decade. Generally, the currently available systems usually comprise a turret mounted on a carriage for rotation relative to the carriage about a vertical axis. This carriage itself is movable back and forth along a track. In addition, the turret carries a cantilever-mounted arm which projects at right angles to the track and includes downwardly facing flock extraction means (for example including a rotatable, spiked roller). Flock material is extracted from the upwardly facing surfaces of bales laid out alongside the track. Extracted flows are fed to a suction system including a transport duct extending along the track and connected to suitable transport ducting in the spinning mill as a whole. In the past, rotation of the turret to move the arm from one side to the other of the track has usually been effected manually. Such rotation would be performed, for example, after fiber material on one side of the track had been exhausted and a new bale lay out had been prepared on the other side of the track. The back and forth movement of the carriage for flock extraction on one track side, and control of operation of the extraction arm on that side, has however been substantially automated and brought under computer control.

Machines incorporating automatic rotatability of the turret are becoming commercially available to an increasing degree.

It is an object of the present invention to enable exploitation of the additional flexibility and versatility provided by the new developments in the field while retaining adequate simplicity in respect of information and instructions required by the machine control system from the machine user.

THE INVENTION

Briefly, the invention provides a flock delivery system which comprises a carriage adapted to move on a predetermined path and a flock extracting means on the carriage. In addition, a means is provided to define a "field of operations" in a predetermined relationship to the path and selectively operable means is also provided to define at least one zone within the field where at least a predetermined operation is inhibited. Means may be provided to define a plurality of blocks within the field. A control means may be selectively operable to apply at least one predetermined control program to the blocks individually. Means may also be provided for selective operation to permit or inhibit application of the predetermined operating control programs to each block individually, particularly but not exclusively to permit or inhibit extraction of flocks from within the defined blocks.

The control means may comprise a micro-computer.

The control means may comprise a data storage means, in or associated with the micro-computer. Means may then be provided to enable selective conditioning of this data storage means. The data storage means may be selectively conditionable to represent a "picture" of the field. The data storage means may, for example, contain storage cells which can be associated respectively with specific locations on, or specific stretches of, the predetermined path. There may be two groups of such cells associated respectively portions of the field on opposite sides of the path.

Conditioning of the data storage means may be dependent upon inputs from both the block defining means and the release/inhibit means.

Means may be provided to indicate the relationship between the flock extracting means and the defined blocks. The flock extracting means may be arranged to move over only one portion of the field (on one side of the path) at a time and may be movable relative to the carriage from one side of the path to the other. The indicating means may then comprise means for indicating the position of the carriage along the path and means for indicating the disposition of the flock extracting means relative to the carriage.

The block defining means may comprise data entry means selectively operable by the machine user to specify blocks to be defined. The required form and content of the data entry will depend upon the detailed design of the system. By imposing suitable (arbitrary, but appropriately chosen) constraints upon the definable blocks, it is possible to specify the blocks by reference to only very few characteristics thereof. For example, a predetermined notional array of blocks may be established containing a predetermined maximum number of blocks. The blocks may have preset relative positions within the array, but be of variable relative sizes. As a further arbitrary constraint, the array may be symmetrical about the path of the carriage. If, as in the current conventional practice, the flock extracting unit itself is designed to respond directly to so-called bale groups (or markers identifying such groups) then each block in such an array is adequately specified by reference to the number of bale groups within it.

The release/inhibit means may be arranged to operate on the control means to prevent entry of the flock extracting means into a block where extraction of flocks is not required. Alternatively, the release/inhibit means may be arranged to operate on the control means to ensure that the flock extracting means adopts a predetermined condition when entering a block in which flock extraction is not required. Preferably, said predetermined condition is "safe" as well as adapted to prevent flock extraction.

The block defining means and the release/inhibit means may comprise means adapted to receive predetermined data, for example by manual entry. The microcomputer may be adapted to set its own programming in response to and in dependence upon the thus entered data.

By way of example, currently available machines and one embodiment of the invention will now be disclosed with reference to the accompanying diagrammatic drawings, in which:

FIG. 1 is a plan view of a bale opening installation in accordance with the currently commercially available state of the art, FIG. 2 is a side elevation of the installation shown in FIG. 1, FIG. 3 is a diagram illustrating a broader range of applicability of the present invention, FIG. 4 is a plan view similar to FIG. 2 illustrating the basic principle underlying the present invention, FIG. 5 is a plan view similar to FIG. 4 showing further details of a practical realization of the principle illustrated in FIG. 4, FIG. 6 is a diagram of some aspects of a microcomputer control system for an installation in accordance with FIG. 5, FIG. 7 is a highly diagrammatic representation of a data storage register in the micro-computer of FIG. 6, FIG. 8 is a diagram illustrating further aspects of the micro-computer control of the installation of FIG. 5, FIG. 9 is a diagram illustrating certain elements of the micro-computer shown in FIG. 8, and FIGS. 10 and 11 show additional details of one of the variants briefly described with reference to FIG. 3.

PRIOR ART/DEFINITION

By way of introduction, machines currently available from Rieter Machine Works, Ltd will be described with reference to FIGS. 1 and 2. At the same time, the opportunity will be taken to define and explain certain terms which apply equally to the state of the art and the present invention.

FIG. 1 shows a lay out diagram of a bale opening installation incorporating a bale opening machine currently supplied by the above noted company under the name UNIFLOC. The machine comprises a flock extracting unit 11 made up of a carriage 10, a turrent 12 rotatable relative to the carriage 10 about a vertical axis (not shown) and an arm 14 on the carriage. This arm will be further described below.

Carriage 10 is reciprocable (by means not shown) along a straight-line path defined by a track 16. At one end of this path there is a power cabinet 18 from which extendable and retractable power leads (not shown) extend to the movable carriage 10. Cabinet 18 forms a convenient point of reference for the carriage movements; movement of carriage 10 away from cabinet 18 will be referred to as "forward" and movement of the carriage towards cabinet 18 will be referred to as "backward" movement. In relation to the path, "left" and "right" can be arbitrarily defined by reference to the forward direction of movement, so that the left hand side (L) is in the upper half of FIG. 1 and the right hand side (R) is in the lower half of that Figure.

As best seen in FIG. 1, arm 14 normally extends away from turret 12 in a direction at right angles to track 16. The arm is illustrated on the left hand side of the track, but turret 12 can be rotated to dispose arm 14 on the right hand side. As carriage 10 moves along the track 16, arm 14 is moved over a fiber bale receiving surface or "floor" indicated at 20 in FIG. 2. Floor 20 provides a height reference for the installation. As will be further described below, fiber bales are disposed on the floor 20 to either side of track 16. As carriage 10 moves along the track, arm 14 is arranged to extract fiber flocks from the upwardly facing surfaces of the fiber bales and to pass them to a suction duct extending longitudinally of the arm, downwardly through the turret 12 and along the track 16 to the end thereof remote from cabinet 18. The fiber flocks are then transferred to a transport duct, indicated in dotted lines at 22 in FIGS. 1 and 2, by means of which the flocks are transferred to downstream processing stages in the spinning mill. The system thus far disclosed is generally in accordance with U.S. Pat. No. 4,566,152, the disclosure of which is hereby incorporated in the present specification by reference.

Depending upon the details of the machine design, there will be a certain maximum area of floor 20 within which fiber bales can usefully be disposed for extraction of flocks by the arm 14. In view of the rotatability of turret 12, this maximum layout area will be divided into respective left and right hand sub-areas disposed on opposite sides of track 16. In FIG. 1, the left hand sub-area is indicated at 24 and the right hand sub-area at 26. The machine user is not forced to exploit the whole of the maximum possible layout area. He can select a more limited area within the maximum possible by limiting the permitted movement of unit 11 along track 16—known arrangements for enabling this will be described later. The selected layout area is referred to herein after as the "field".

The fiber bales processed in spinning mills are commonly obtained from a variety of sources. Since bale sizes are not standardized, the upwardly facing surfaces of bales laid out on floor 20, which is assumed level, will be at different heights. It is therefore standard practice to form the bales into "groups", the bales within any one group being of similar (preferably identical) height but the bale-groups being of different heights. In order to cope with this, arm 14 is vertically movable on turret 12, as indicated by the doubleheaded arrow in FIG. 2. The maximum permitted number of bale-groups will be determined by the machine design. The number will be determined by reference to required operating efficiency bearing in mind the requirement to reset the height of arm 14 between bale-groups. In the UNIFLOC machine referred to above, a maximum of four bale-groups per machine side is permitted and examples of such an arrangement are shown at G1, G2, G3 and G4 in the right hand sub-field of FIG. 1 and in FIG. 2. It is, of course, not necessary to exploit the full capability of the machine in this respect and a lay out having only two bale-groups is indicated diagrammatically in the left hand sub-field in FIG. 1.

As indicated above, bales are "grouped" according to height. Further, they are preferably arranged to optimize exploitation of floor area within the effective field of the machine, and to support each other against sideways forces applied in use by the extractor arm 14. As clearly seen in FIGS. 1 and 2, bale-groups are commonly spaced longitudinally of track 16; this facilitates distinguishing of the different groups by the flock extracting unit 11 and appropriate resetting of arm 14 for operation on the next group in line. Such systems have been shown, for example, in German published patent application (Offenlegungsschrift) No. 3335792. In the system disclosed in that specification, bale-groups are distinguished by sensors responsive directly to the bales themselves. In an alternative system, briefly referred to in the German specification, bale-groups are distinguished by means of "markers" separate from the bales, but appropriately located relative to the groups, for example along the track 16. In the detailed embodiment to be described with reference to FIG. 5, this latter, alternative system is used, but the present invention can be applied to both systems.

The flock delivery capacity of a bale opening installation of the type shown in FIG. 1 is very high, and may be sufficient to supply more than one downstream receiving and processing line. For example, if the delivery capacity is sufficient to supply two such downstream lines, then transport duct 22 may have a fork as indicated at 28, and a divertor 30 may be incorporated in the duct to direct delivered flock material into one arm or other of the fork 28. An arrangement of this type is shown, for example, in U.S. Pat. No. 4,587,691.

Where the flock delivery installation is supplying more than one downstream line, there is the possibility of supplying different fiber-blends to the different lines. This provides a second, independent reason for grouping fiber-bales in the extraction field. For example, fibers from bale-groups G1 and G2 in FIG. 1 might be fed to a first downstream line, and fibers from bale-groups G3 and G4 to a second downstream line. The operation of divertor 30 must then be coordinated with the movements of carriage 10, so that extracted flocks are supplied to the correct downstream line. Systems which enable this are already well known in the spinning art and will not be described herein. An installation operating in this way can be considered to be supplying two fiber "sorts". The first "sort" comprises, for example, a blend of fibers extracted from bale-groups G1 and G2, and the second "sort" comprises a blend of fibers extracted from bale-groups G3 and G4.

In the simple mode of operation of an installation as illustrated in FIG. 1, the flock extracting unit 11 moves continuously from one end to the other of its extraction field, so that the arm 14 sweeps over all of the bales in either the left hand or right hand sub-field. The unit is then reversed to sweep over all the bales in the opposite direction. Movement of the unit between successive reversals is referred to hereinafter as a "pass". In currently available machines, the length of a pass is equal to the length of the field.

Assuming optimum exploitation of the effective extraction length of arm 14, during any one pass the instantaneous delivery rate of fiber flocks into duct 22 will be dependent upon the speed of movement of carriage 10 and the depth of layer of fibers removed from the bales. There will be a certain maximum instantaneous delivery rate dependent upon the design of the flock transport system taking flocks from the installation. Even if the installation is maintained in "continuous" production, however, the effective maximum production rate over a longer period (say, per hour) will be less than the instantaneous maximum referred to above because some "dead time" is inherent in the system. For example, in UNIFLOC which can extract flocks in both directions of travel of the carriage, even if there is only one bale-group, the extraction unit must be reversed at each end of a pass with some resultant loss of effective production time. There will be further dead time between bale-groups. In other machines, which can extract flocks in only one direction of travel of the carriage, a "return pass" must be inserted between each "extraction pass".

The actual production rate will normally be lower than the effective maximum, because the "call" for fiber material from the downstream lines will be discontinuous, depending upon varying operating rates of the downstream lines.

In the currently operating UNIFLOC installations of the type shown in FIG. 1, the turret 12 is manually rotatable. In such installations, in any period of continuous production, the flock extraction unit is operating upon bales in only one sub-field. Meanwhile, of course, a new bale lay out can be made up in the other sub-field. It has, however, already been proposed that the turret 12 should be automatically rotatable under the control of the machine itself. Such a system is shown, for example, in U.S. Pat. No. 4,712,275. The present invention is intended particularly, but not exclusively, for systems in which this capability is available. As will be explained further below, the invention enables exploitation of the additional flexibility provided by automatic rotation of the turret. First, however, additional remarks will be made with reference to FIG. 3 concerning applicability of the invention.

FIG. 1 shows the general arrangement of the currently available installations, and the present invention will be described in detail by reference to such installations (FIGS. 4 and 5). As will now be described with reference to FIG. 3, however, the invention is of much wider applicability. That Figure shows a circular carriage path, defined by a corresponding track 16*a;* the turret 12*a* is not rotatable, because it is fitted with two flock extracting arms 14*a*, 14*b* respectively projecting in opposite directions to either side of track 16*a*. The extraction field therefore comprises an inner annulus 24*a* and an outer annulus 26*a*. Although not specifically illustrated, the floor 20 to either side of the track (16 or 16*a*) could be provided by raisable and lowerable platforms, bales being loaded with the platforms in the lowered position and flock extraction being effected with the platforms in the raised positions. If the platforms could be adequately sub-divided, then it may no longer be necessary to raise and lower the arm 14 or arms 14*a*, 14*b* relative to the turret. In a further non-illustrated arrangement, the turret may have only a single arm, which may be reciprocable across the track instead of rotatable as described with reference to FIG. 1.

In a still further alternative, there could be two parallel straight tracks, each with its own carriage. The flock extracting means could be in the form of a bridge-like member supported between the carriages. Half the length of the flock extracting bridge could feed a duct in one track and the other half could feed a duct in the other track. Further, the track(s) is or are not necessarily on the floor. One or more overhead rails could be provided and the carriage(s) could be suspended therefrom. In a still further alternative, the bales could be arranged as a "wall" and a vertically oriented flock extracting member could be moved back and forth parallel to the wall of bales.

In all embodiments, however, there is a predetermined path for the movable flock extraction means, and a field in a predetermined relationship to the path.

PREFERRED EMBODIMENTS

FIG. 4 shows an installation of the type shown in FIG. 1 and parts common to both Figures are indicated with the same reference numerals. In FIG. 4, the significant point is the definition of a plurality of "blocks" as further explained below. Four such blocks have been assumed and they correspond with respective zones floor areas within the field as indicated at B1, B2, B3 and B4 respectively, so that each subfield 24, 26 has two blocks and two corresponding zones. As will be explained in detail later in this specification, the control system for the flock extraction unit is programmed to operate on each block individually. Further the control system can be conditioned selectively to "permit" or "inhibit" extraction of flocks from bales in each block individually.

The number of blocks defined in any individual installation will be dependent upon the designed purpose of that installation. In the installation shown in FIG. 4, the two blocks in each sub-field correspond respectively to the two downstream lines fed by the installation as described with reference to FIG. 1. Thus, if those lines are processing fibers of different sorts, bales for the first fiber sort can be laid out in, say, the zones of blocks B1 and B3 and bales for the second fiber sort can be laid out in, say, the zones of blocks B2 and B4. The flock extraction unit will be able to supply fiber material to both lines on each pass. However, this gives only one example of the use to which the "block concept" can be put; the increased flexibility provided by rotatability of the turret 12 and the block concept for the control system can be exploited in many other ways. As a further example, bales commonly have different densities at different depths. Obtaining an even feed of flocks can therefore present problems. Bales at different stages of flock extraction (different depths—different densities) can be located in different blocks and flocks can be extracted from them in sequence. The number of blocks can therefore be selected in accordance with the versatility required for the overall installation and the acceptable cost and complexity of the complete system.

A "block" in the arrangement of FIG. 4 is characterised in that the control system (to be described later) is arranged to apply at least one, predetermined operating program to the block as a unit. Selectively operable release/inhibit means (also to be described later) is provided to permit or inhibit application of the predetermined program(s) to each block individually. The predetermined program controls flock extraction. A distinction is to be drawn between "inhibition" of flock extraction from a given block and a temporary cessation of flock extraction from the same block due to cancellation of the call for material from the downstream processing line. If application of the flock extraction program(s) to a given block is "inhibited", then no flock extraction from that block will occur, even if the relevant downstream line is calling for material, unless and until the inhibition is lifted.

Each block in FIG. 4 includes an individual area (zone) of the floor within the field. In the preferred arrangement (to be described) these zones together make up the complete field. Each block may furthermore include a number of bale-groups (not shown in FIG. 4) laid out in its associated zone. The number of bale-groups is variably selectable within preset limits.

As shown in FIG. 4, the blocks (as well as the zones) are arranged in a predetermined array, namely a 2 x 2 matrix centred on the track 16. The relative positions of the blocks in this array are fixed, but their relative sizes can be selectively varied with one additional constraint —the array must remain symmetrical about the track 16. The reason for this constraint will become apparent from subsequent description. The blocks are therefore effectively organized into two block pairs B1/B3 and B2/B4 respectively. Within each sub-field 24 or 26 each block can be selectively chosen to cover an area from zero (block eliminated from the field) up to the whole sub-field (the other block is eliminated from the sub-field).

The array is such that the blocks in any one sub-field (24 or 26) are arranged in series with respect to a pass of the flock extraction unit. A parallel arrangement of blocks in a sub-field is conceivable, but would require a more complex extracting arm, segregated ducts and complex control.

DEFINITION OF THE FIELD AND THE BALE-GROUPS

Before proceeding to definition of the blocks, the markers used in currently available UNIFLOC installations to define the field and to sub-divide it in accordance with bale-groups will be described. The same markers are used in systems according to the invention.

FIG. 5 is a plan view similar to FIG. 4 but showing a physical lay out of bale-groups without reference to the block concept. Elements common to both Figures are again indicated by the same reference numerals. The right hand sub-field is assumed to contain four bale-groups, G1 to G4 respectively, and the left hand sub-field contains four further bale-groups, G5 to G8 respectively. The path of the flock extraction unit can be notionally divided into five sub-lengths or "stretches" S0, S1, S2, S3 and S4. These stretches are separated by markers Pl, P2, P3, P4 and P5. In FIG. 5, the flock extraction unit is indicated in a starting position relative to its path, this position being defined by a further marker P0 which cannot be seen in the Figure since it is beneath the unit.

The field is defined at one end (start) by the marker P1. Stretch S0 is not therefore a part of the field and bales should not be laid out between markers P0 and P1. This gives a space at one end of the installation for rotation of the turret at position P0. This is a feature of the UNIFLOC design, but is not essential to the invention.

The other end (finish) of the field can be defined by any one of the markers P2 to P5—that is, the machine can be selectively programmed to treat any one of those markers as the finish of the field. Where any marker other than P2 is chosen as the finish of the field, the intervening marker(s) represent bale-group dividers. Arrangements for allocating required functions to the markers will be described later with reference to FIG. 7.

The positions of the markers can be adjusted as required along the track, subject to predetermined maximum and minimum marker spacings dependent upon the machine design.

The bale lay out is such that bale-groups G1 and G5 lie within stretch S1 (between markers P1 and P2), groups G2 and G6 lie within stretch S2, groups G3 and G7 within stretch S3 and the groups G4 and G8 within stretch S4. The illustrated arrangement is convenient because it enables use of only a single set of markers in combination with both sub-fields 24 and 26. Additional versatility could be obtained, at the cost of added complexity, by providing separate marker systems for sub-fields 24 and 26, whereupon the "symmetrical" arrangement of the bale-groups relative to the longitudinal axis of the machine would be unnecessary.

CONTROL SYSTEM—POSITION DETERMINATION

A detector Dp on the carriage 10 is arranged to respond to the markers P0 to P5 respectively and to provide a corresponding signal to a micro-computer MC (FIG. 6). Detector Dp may be a proximity sensor, for example, a magnetic sensor responsive to proximity of the detector to any one of the markers P0 to P5. The form of the signal output from detector Dp will be further discussed later with reference to FIG. 7. A second detector Dr is provided to respond to the position of arm 14 to the left or the right of track 16. For example, detector Dr may be another proximity sensor responsive to a marker X (FIG. 5) on the turret 12. The output signal from detector Dr is also supplied to the micro-computer MC and this signal will also be discussed with reference to FIG. 7. The micro-computer is programmed to act as a basic control system, responding to inputs from detectors Dp and Dr to control the four basic mechanical operating elements of the machine. These elements are indicated only diagrammatically in FIG. 6; they comprise the carriage drive motor CM, the turret rotation drive RL, the arm raising and lowering drive HM and the flock extraction equipment ER carried by the arm 14. An example of suitable flock extraction equipment can be seen in U.S. Pat. No. 4,513,479.

The actual mode of control of the mechanical operating elements in dependence upon the outputs of the detectors will depend upon the selected micro-computer and programming technique. One example will be described in very broad outline with reference to FIG. 7, but alternative techniques are known in the computer art and can be applied to the present invention.

CONDITIONAL DATA STORE

The large rectangle shown in FIG. 7 is a diagrammatic representation of a data storage means in the form of a storage register in the micro-computer referred to hereinafter as the "main register" MR. In the assumed example, this register has 22 storage cells arranged in two groups represented in the diagram by the rows LC and RC respectively to function as a means to represent the physical arrangement of the subdivided field. As indicated by the dotted lines below FIG. 7, the cells of each group correspond respectively to the position markers P0 to P5 and stretches S0 to S4 described above with reference to FIG. 5 and each functions as a conditionable means.

These twenty two storage cells represent respectively twenty two possible positional relationships of the arm 14 relative to a field defined by using all the markers. In four of these relationships the arm is outside the field—when the carriage is at P0 or on the stretch S0. All the other relationships involve positions of the arm 14 within a field. Whether or not such relationships arise during a given flock extraction operation will depend upon how the field is defined for that operation.

Each cell in register MR is conditionable to contain instructions or data which determine operation of the flock extraction unit 11 while the arm 14 remains in the corresponding positional relationship. As will be described later, certain cells (the "P" cells) are selectively, variably conditionable; others (the "S" cells) are set in predetermined conditions identifying the bale group from which flocks are to be extracted or which is otherwise to be processed eg. tested for height.

IDENTIFICATION OF THE CURRENTLY EFFECTIVE CELL

As indicated by the numbers within each cell, for control purposes the cells of each group are allocated a respective identifying number 1 to 11 in the sequence in which the corresponding position markers and stretches (FIG. 5) are reached during movement of the flock extraction unit in the forward direction starting from position P0.

The micro-computer MC also includes a stepping counter SC1. This counter can be incremented or decremented in unit steps in response to pulses received from the marker detector Dp. The counter is arranged to increment during forward movement of the flock extraction unit and to decrement during backward movement thereof. This is controlled by a direction register DR also included in the micro-computer and responding to a detector Dd (FIG. 6) which in turn is responsive to the direction of rotation of the carriage drive motor CM. The relevant group of storage cells LC or RC is selected in dependence upon the left or right hand position of arm 14 by a further register ("side" register SR) which responds to inputs from the detector Dr (FIG. 6). Register SR may, for example, contain a 0 when arm 14 is disposed to the left of track 16, and a 1 when arm 14 is disposed to the right of track 16. The arrangement is set so that counter SC1 contains a 1 when the flock extraction unit is in its starting position P0. If the carriage motor CM is set to drive carriage 10 in the forward direction, then direction register DR is supplying a signal to counter SC1 causing that counter to increment in response to pulses it receives from detector Dp. This latter detector produces such a pulse when carriage 10 departs from the starting position, so that a "2" is now entered in counter SC1; as can be seen from FIG. 7, this indicates that the flock extraction unit is currently on the stretch S0. The simultaneous condition of side register SR will indicate whether the arm 14 is extended to the left or the right of track 16, and hence whether cell LC2 or RC2 is the appropriate one.

When the flock extraction unit reaches marker P1, detector Dp supplies a further pulse to counter SC1, which increments so that a "3" now appears in the counter. A further pulse is received by the counter from detector Dp when the flock extraction unit departs from marker P1, so that a "4" appears in the counter indicating that the unit has entered stretch S1. The condition of side register SR again indicates whether cell LC4 or cell RC4 is the appropriate one; as can be seen by reference to FIG. 5, this represents information as to whether the flock extraction unit is to operate upon bale-group G1 or bale-group G5. As will be described later, the micro-computer will control the operations of the flock extraction unit accordingly while the unit continues to move along the stretch S1.

Assuming continued forward movement of the flock extraction unit, counter SC1 is incremented upon arrival at and also upon departure from each of the position markers P2, P3 and P4. The counter is also incremented upon arrival at the position marker P5, so that an "11" then appears in the counter. Upon arrival at each of the position markers, the micro-computer checks the corresponding P cells in register MR (cells 1, 3, 5, 7, 9, 11 in either the left hand or right hand group) for instructions. Each cell 11 contains an instruction to reverse the direction of the carriage drive motor CM, so that direction register DR is reset to cause counter SC1 to decrement during the backward movement of the flock extraction unit towards its starting position. Thus, if the unit is returned as far as the starting position P0, this is indicated by a pulse from detector Dp changing the condition of counter SC1 from "2" to "1".

BLOCK DEFINING MEANS

An essential aspect of the definition of a block is the definition of the zone associated therewith.

As in the currently conventional UNIFLOC machine, the markers P1 to P5 define the ends ("start" and "finish") of the bale-groups for control purposes. The zones in an array as shown in FIG. 4 are now defined by selectively adjusting the "status" of the markers P1 to P5 by entry of appropriately selected instructions in the corresponding P cells. The selection of the appropriate instructions will be described later. Since the field is the sum of the block zones i.e. the floor areas of a flock, the field is defined simultaneously with those zones. Marker P1 always has the status of a "block defining marker" (as an addition to its status as a "bale-group defining marker"). Marker P5, if it is selected for inclusion in the field, also functions as a block defining marker. Markers P2 to P4 can function selectively either as simple bale-group defining markers or additionally as block defining markers.

For example, in the arrangement of FIG. 5, the markers P2, P3 and P4 represent dividers separating the bale groups. By entering appropriate instructions in the cells of main register MR, the same markers can be used either as mere bale-group dividers or they can be selectively "elevated" to the status of block dividers. In the relatively simple arrangement of FIG. 4, with only two blocks per sub-field, only one block divider is required per cell group LC and RC. By reprogramming, altering the instructions in main register MR, the status of any previously selected one of the markers P2, P3 and P4 as a block divider can be cancelled. In this event, another selected one of those markers can be elevated to the status of block divider, or none of those markers may be allocated that status. In the latter event either block pair B1 and B3 or block pair B2 and B4 is effectively cancelled (eliminated from the field) and each block of the remaining pair extends from end to end of its respective sub-field.

Determination of the status of the markers is under the sole control of the machine user, i.e. marker status cannot be altered by the machine itself. Any of the currently available means for selective entry of data into a micro-computer may be used to indicate required status.

In the arrangement illustrated diagrammatically in FIG. 8, a manually operable data infeed unit DI (e.g. a keyboard) is used to feed data specifying each block into the microcomputer.

In the preferred arrangement, shown diagrammatically in FIG. 8, a translator unit T is interposed between the manually operable data infeed unit DI and the main register MR. Actual entry of instructions into register MR is effected by the translator unit in response to certain basic data (including the block specifications) entered by the user at DI. The form of the required basic data can thus be adapted to user convenience while ensuring that the appropriate instructions are entered in the main register.

The preferred form for block specifying data at DI is the entry of the number of bale-groups in each of the respective blocks B1 to B4. This data specifies both the zone associated with the block and also simultaneously any required sub-division within the block (multiple bale-groups or single bale group). For this purpose, as indicated diagranmatically in FIG. 8, unit DI could include four sub-units BlN to B4N respectively (referred to collectively as the "BN units") each of which could be operated to indicate the number of bale-groups in the corresponding block B1 to B4. This information is interpreted by the translator unit T as appropriate "status information" for the markers and is used to generate appropriate instructions for the cells of main register MR.

In FIG. 8, four sub-units BN have been shown to emphasise the principle involved. In practice, only two actual entries are required, because the symmetrical layout constraint implies that the number of bale-groups in block B1 is equal to that in block B3, and the number in B2 is equal to that in B4. The number of entry units, e.g. keyboard units, can be adapted accordingly.

The user is free to allocate to block B1 either no bale-groups at all or any whole number of bale-groups up to the maximum number of groups which the flock extraction unit can handle in one pass (in the given example—four). The user is also free to allocate to block B2 either no bale-groups or any whole number of bale-groups provided that the total number of groups allocated to sub-field 26 does not exceed the maximum referred to above.

Specification of the blocks by reference to the number of bale-groups in each is alone sufficient to determine the required status for each of the P markers. However, it is not sufficient alone to determine the specific instructions to be inserted into the relevant P cells in order to represent that status.

The specific instruction to be entered into a P cell in a given case must be selected by unit T from a group of five possible instructions, namely:

(i) carriage forward—block defining instruction
(ii) carriage return—" " "
(iii) turret rotation—block defining instruction
(iv) block separation—" " "
(v) bale-group separation—bale group defining instruction Each of instructions (i) to (iv) is a block defining instruction—instruction (v) designates its marker merely as a sub-divider within a block. The block specification data entered by the user determines which cells are to receive block defining instructions and which (if any) receive merely bale-group defining instructions. The choice between the possible block defining instructions is made on the basis of additional release/inhibit data now to be described.

RELEASE OF THE BLOCKS

Definition of the blocks as described above is not sufficient for control of operation of flock extraction unit 11. The unit must also "know" whether it is required to perform any operations within the defined blocks, and if so which operations. The answer to the first of these questions is initially programmed on the basis of data supplied by the machine user via the unit DI (FIG. 8). For this purpose, unit DI has four additional sub-units BlR to B4R respectively (referred to collectively as the "BR units") corresponding once again with the blocks B1 to B4. Each of these latter sub-units is arranged to permit an indication as to whether the relevant block is "released" for flock extraction, or whether flock extraction from that block is to be inhibited. The data thus entered into the control system can be used in a number of different ways. In the preferred arrangement, which will be further described later, release data is used by the translator unit to program the main register MR so that the arm 14 cannot move into a block in which flock extraction has been inhibbited. For this purpose instructions can be entered in the marker cells of the "inhibited block" causing suitable reversals of the carriage motion. Alternatively, the arm might be permitted to enter an inhibited block provided the arm is in a predetermined condition, for example fully raised and/ or inoperative, e.g. by stopping the flock extraction equipment or by closing safety doors on the arm.

Assuming, however, that the flock extraction unit is required to perform operations within a block, then appropriate predetermined control routines ("processing routines") must be made effective upon the control system as the arm 14 enters the block. That is, the control system must apply these predetermined routines to processing of bales within the block. Processing routines themselves will not be dealt with in any detail in this specification. Processing routines for bale-opening machines are now well known and are not as such the subject of this invention. Some examples can be seen from U.S. Pat. Specification No. 4,297,766 and German Published Patent Specification (Offenlegungsschrift) No. 3335793, but alternatives to these routines, together with routines for other purposes, are currently available. The addressing of such routines will however be described later with reference to FIG. 9.

CONDITIONING OF THE MAIN REGISTER

It is believed clear from the above that the translator unit T initially generates a set of instructions for the P cells of register MR on the basis of data entered from both the block specifying means (units BN) and the manually operable release/inhibit means (units BR). Each set of instructions is made up by selecting appropriately from the group of five instructions (referred to above in the section headed "Conditionable Data Store") for each of the P cells—the number of possible sets is clearly very large and the sets cannot usefully be itemised here. It is worth noting, however, that the Pl cells (in a UNIFLOC machine) will normally contain either "carriage forward" or "turret rotation" instructions and the P5 cells will normally contain "carriage return" instructions. The instructions possible in the other P cells depend to some extent upon any constraints imposed, as discussed later.

When the unit 11 is operating to extract flocks, the set of instructions in register MR must include at least two carriage direction instructions causing the unit to move back and forth over at least one block. The length of a pass may therefore now be shorter than the length of the field. The set of instructions does not necessarily include any block separation instruction—as indicated above, the block pairs can be selectively eliminated by setting their bale-group number equal to zero. The set of instructions also does not necessarily contain a turret rotation instruction—the unit can be released for operation in only one sub-field. Some operating patterns requiring different instruction sets will be described later.

The instruction set in register MR is not, however, unalterably fixed by the initial data entered by the user. Apart from the possibility of complete new programming, corresponding to a new layout of the field, the present invention enables relatively easy "updating" of the instruction set for a given defined field in dependence upon alteration in the release/inhibit data. Such alterations can be effected by the machine user and by the machine itself in response to completion of certain processing routines. Alteration by the machine user is clearly effected via units BR at DI (FIG. 8) and causes cancellation of previously entered release data and substitution thereof by newly entered data—thereby causing translator unit T to generate a new set of instructions for the P cells corresponding to the new data.

This capability enables very flexible programming by the user—a previously entered program for a given field layout can be altered at any time by altering the block release data. This is true even if the user wishes to inhibit a previously released block while the unit is actually operating on that block In a case in which the conditioning of the S cells is preset and unalterable, the unit may remain operable within the newly inhibited block until it reaches a boundary at which it can leave the block. It will not then re-enter until the inhibition is lifted. Modifications to be described later enable the arm 14 itself to adopt an "inhibited" state as soon as the new instructions are entered in register MR. Alteration of block release in response to machine generated signals will be described in the course of the description of FIG. 9.

OPERATIONS REGISTER

As shown in FIG. 9, the micro-computer contains an additional register ("operations" register) OR containing four cells associated respectively with the blocks B1 to B4. For ease of description, the cells are arranged in a 2 x 2 matrix having a right hand column containing the cells for blocks B1 and B2 and a left hand column containing the cells for blocks B3 and B4. Switching from the right hand to the left hand column is effected in response to signals from the side register SR already described with reference to FIG. 7 and illustrated again in FIG. 9.

Switching between the rows of the matrix, that is between blocks B1 and B2 and blocks B3 and B4 is effected in response to signals from a "line" register LR. This latter register responds in turn to signals received from the direction register DR (already described with reference to FIG. 7 and indicated again in FIG. 9). It also responds to signals supplied by the micro-computer on an input 32 when a block dividing marker is detected during examination of the currently effective cell in main register MR. Further, register LR is settable by the microcomputer (via an input 34) in dependence upon the field layout entered by unit T in register MR. Thus, when carriage 10 leaves marker P1, register LR is conditioned to indicate which block pair (B1/B3 or B2/B4) the arm 14 has entered. A decision between the blocks of the pair can be made in dependence upon the condition of side register SR as already described. When the carriage 10 departs from a block dividing marker (selectively determined by the block defining means as described above) the condition of register LR is changed in a sense indicating movement over the boundary between the block pairs. The sense of the movement over this boundary is determined by the condition of direction register DR.

The cells of operations register OR contain instructions identifying the processing routines currently effective for their respective blocks. The contents of each cell can be updated by the micro-computer to take account of operations already performed upon the relevant block. This register may be considered as an indicator of the state of each block, that state determining the currently applicable processing routine. The latter may be dependent upon the "stage" of processing bales as previously described.

The instructions in the cells of register OR can be of very varied types depending upon the detailed design of the machine (its possible processing routines). For purposes of example only, three types of instruction can be considered, namely (a) prepare (for flock extraction)

(b) flock extraction (c) (flock extraction) completed.

In response to the prepare instruction (a), the machine performs certain preliminary operations within the relevant block, e.g. sensing of the height of the bale-group(s) therein. When these preliminaries are completed, the micro-computer substitutes instruction (b) and when flock extraction is completed, the microcomputer substitutes instruction (c). The insertion of this latter instruction in a cell of register OR causes a change in the conditioning of the main register MR.

Thus, in response to detection of a "completed" instruction in one of the cells of register OR, the microcomputer supplies a signal to translator unit T (FIG. 8) cancelling the release for the relevant block. The microcomputer can thus override the data originally entered via the manually operable BR unit at DI. The translator unit therefore generates a new set of instructions for the P cells of register MR —as already described above with reference to manually entered block release changes. The override is, however, only possible in one sense - namely inhibition. A block can be released for flock extraction only in response to data entered manually at DI.

When the new set of instructions has been entered in main register MR, the micro-computer cancels the "completed" instruction in operations register OR and substitutes a "prepare" instruction in the relevant cell. The system is therefore ready for restart of operations on the relevant block as soon as that block is released by manual operation at DI. When the unit 11 is initially started from position P0 after a totally new layout has been prepared, the user presses a "start" button (not shown) which causes entry of "prepare" instructions in each of the cells of register OR. Thereafter, the operations register is updated by the microcomputer itself until automatic operation is cancelled by the user.

ADDITIONAL DATA

An additional register (not shown) can be provided with eight cells associated with respective bale-groups G1 to G8. Each cell can contain basic data regarding its respective bale-group as required for performance of the operations called for by operations register OR; for example, the bale-group register may store information regarding the heights of the respective groups, their lengths, the depths of the layer which is to be removed from each on one pass etc. Such data can also be updated by the micro-computer in dependence upon operations performed upon the relevant bale-group. Such registers are already used in practice and form no part of this invention. They are addressed in dependence upon the identifying data contained in the S cells.

It is worth noting that blockwise "enabling" and "disabling" of processing routines excludes the use of separate processing routines for sub-divisions (e.g. bale-groups) within a block. Thus, whether or not the block is sub-directed into a plurality of bale-groups, all bales in the block will be operated upon in accordance with the currently effective processing instruction for that block (eg "prepare" or "extract"). Also, all of the block will be "released" or "inhibited" (ie. its processing program will be "enabled" or "disabled") simultaneously. As will be discussed later in this specification, however, the release/inhibit concept is not limited to use in conjunction with the block concept.

OVERALL OPERATION—SUMMARY

Returning now in summary to the diagrams in FIGS. 5 and 7, it is noted that in the preferred arrangement (a) the "S" cells in register PR contain invariable (predetermined) data identifying the portion of floor 20 currently underneath the arm 14; data in the S1 to S4 cells enables the micro-computer to identify the bale group to be processed and extract additional data from the appropriate bale-group register, (b) the "P" cells (or at least some of them) must be variably conditionable to enable selective instruction of the micro-computer regarding at least the required direction of travel of the carriage and the initiation of any adjustment operations required prior to entry into the next track stretch, and (c) in addition, at least some of the "P" cells must be selectively programmable to provide an indication that the flock extraction unit has arrived at a block defining boundary, enabling adjustment before entereing a new block.

The processing operations addressed via the operating register OR are enabled or disabled for each block as a unit, as indicated in the description of FIG. 9.

The exploitation of the blocks for specific purposes will depend upon the overall design of the installation and to some extent upon the design of the machine.

Some operating patterns will be described further below after some remarks regarding the alternative possibilities for programming the control means.

ALTERNATIVE PROGRAMMING TECHNIQUES

The main register MR described with reference to FIG. 7 is based upon one of the currently normal programming techniques involving establishment of a "look-up" table to which reference is made for instructions upon the occurrence of a predetermined event. The invention is not limited to the use of this programming technique. In an alternative technique, also commonly used in the current programming art, a series of decision making steps (based for example upon a decision flow-chart) is worked through in response to each of the predetermined events. Since the alternative technique is well known, it will not be described in this specification. It is, however, equally applicable for use in the present invention; a step must be built into the decision making procedure requiring a decision as to whether a block defining boundary has been reached; a second step must be built into the procedure to determine whether the block is "free" or "inhibited". The rules for taking such decisions in the individual cases can be determined in accordance with data selectively fed in by the machine user, for example as already described with reference to FIG. 8. The release data must be alterable in response to machine-generated signals as described with reference to FIG. 9. A register in the form shown in FIG. 7 may no longer be required.

EXPLOITATION OF THE BLOCK-DEFINING CAPABILITY

It is emphasized firstly that sub-division of the extraction field so that each sub-field includes a plurality of blocks is a capability of the machine but is not essential to the operation thereof in a specific case. Thus, as already indicated above, blocks B1 and B3 can be made coextensive with their respective sub-fields, with corresponding elimination of blocks B2 and B4. The appropriate data (N=0) must nevertheless be entered for blocks B2 and B4 at unit DI described with reference to FIG. 8. Similarly, blocks B2 and B4 can be retained and blocks B1 and B3 eliminated.

The most advantageous use for the block principle is in the processing of different fiber sorts while delivering to respective processing lines as previously described with reference to FIG. 1. In this case, fibers of the different sorts can be placed in respective blocks, and an indication that the flock extraction unit has reached the boundary between two blocks can be used to cause special adjustments required for processing of the different fibers. For example, the flock delivery installation itself might be "blown out" to avoid undesired mixing of the two fiber sorts. The fiber receiving system can also be adapted, for example by adjustment of the divertor 30 shown in FIG. 1. The micro-computer can be caused to issue the required signals after sensing of the block boundary in the main register MR.

The allocation of fibers of different sorts to respective blocks will depend to some extent upon the design of the machine itself. In particular, the question of whether the turret 12 can be rotated at any desired marker is relevant. An associated question is whether the extraction arm 14 is effectively reversible, that is, whether or not flocks can be extracted during travel of the carriage 10 in both directions along the track 16. In the immediately following paragraph, the UNIFLOC system will be assumed, that is the arm 14 comprises a reversibly rotatable, spiked roller (not shown) so that flocks can be extracted during travel of the carriage in both directions. An instruction causing a carriage reversal must therefore also cause reversal of rotation of the roller. The turret 12 can be rotated only at the starting position P0. Some remarks will subsequently be made about the applicability of the block principle to alternative machine designs.

In the UNIFLOC system adapted to provide a four-block capability as described with reference to FIGS. 4 and 5 the "near" blocks (B1 and B3) are allocated to one downstream processing line and the "far" blocks (B2 and B4) are allocated to a second line. This allocation is preset into the system i.e. not selectively controllable by the user. A block separation instruction in a P cell of register MR (FIG. 7) causes the micro-computer to issue a signal changing the condition of divertor 30 (FIG. 1) in the appropriate sense. This preset allocation acts as an additional constraint on the exploitation of the system—it is not essential, but it enables simplification of the input data required from the user. If the constraint is not applied, then the user must specify whether a block change is associated with a processing line change and the range of possible instructions for block separation must be broadened accordingly.

It is also useful to automatically exclude certain theoretical possibilities by programming the micro-computer to reject them when entered at the data infeed unit DI (FIG. 8). The reasons for this will be explained further below, but first the permitted possibilities will be dealt with briefly.

PERMITTED POSSIBILITIES (i) flock extraction from any single selected block (one processing line); no rotation of the turret is required during flock extraction operations; carriage 10 is caused to move back and forth over the stretch or stretches of track 16 associated with the selected block; work, for example lay out of bales, can be performed in the other blocks, (ii) flock extraction from a pair of blocks in the same sub-field (two processing lines); turret rotation is not required; fibers of different sorts can be placed in the respective blocks; work, such as laying out, can be performed in the other sub-field, (iii) flock extraction from all four blocks; rotation of turret 12 is required; the instruction set in register MR can be arranged to cause turret rotation each time the carriage is returned to position P1, or preferably only when the fiber material in one sub-field has been exhausted; in the latter, preferred, case the translator unit T must be adapted to place a "temporary inhibition" on one of the selected sub-fields and to lift the inhibition by generating a new set of instructions including a turret rotation instruction in response to a "completed" signal for the first sub-field; fiber of a first sort can be placed in blocks 1 and 3 and of a second sort in blocks 2 and 4, the required resetting of the system being effected when the common block dividing marker is reached, (iv) flock extraction from the two blocks nearest to the starting position (designated B1 and B3 in FIG. 4); this is a cut-down version of the preceding possibility (but with delivery to only one processing line), (v) flock extraction from the two blocks furthest away from the starting position (designated B2 and B4 in FIG. 4); the computer is programmed to accept this entry only if the number N of bales in blocks B1 and B3 is set equal to zero so that blocks B2 and B4 start at marker P1; as in cases (iii) and (iv) the micro-computer is preferably programmed to ensure that the extractor arm 14 is moved from one of the selected blocks to the other only after supply of material in the first selected block (B2 or B4) is exhausted, that is turret 12 is rotated only after completion of extraction of material from one of the blocks; a "temporary inhibition" may be generated by the translator unit as discussed above; since blocks B1 and B 3 have been eliminated from the field, the unit is not required at any stage to enter an inhibited block.

(vi) selection of the two blocks (B1 and B3) nearest to the starting position and one of the blocks (B2 or B4) furthest away therefrom. This "triple block" layout could enable, for example, a relatively high rate of flock delivery over time to one processing line and a relatively low rate to another. The unit is programmed to cause rotation of the turret each time the carriage returns to position P1 (the full turret rotation operation involves movement of the carriage to position P0, turning of the turret at position P0 and return to position P1). The possibility is permitted but is not recommended.

NON-PERMITTED POSSIBILITIES

The micro-computer is programmed to exclude (or reject) the following possibilities if they are entered into the data infeed unit DI.

(i) flock extraction from one of the blocks near to the starting position (B1 or B3) and the diaagonally opposite block (B4 or B2) in the other subfield, (ii) flock extraction from both blocks in one sub-field and the block furthest from the starting position (B2 or B4) in the other sub-field.

These possibilities are excluded for essentially the same reason, namely to avoid movement of the extraction arm back and forth across an "empty" block. This exclusion is desirable for safety reasons, bearing in mind the fact that delivery of flocks to two lines is required so that extraction cannot be restricted to completion in one sub-field before start in the other.

From the above, it will be seen that "triple-block" operation can be specifically programmed provided both of the "near blocks" (near to the starting position) are selected. Apart from specific programming, however, there is the possibility that a "three-block situation" will arise during processing of an originally "four-block" lay out, since there is no provision in the system to ensure that all four blocks are exhausted simultaneously. The micro-computer is programmed to react to a non-programmed, three-block situation by eliminating the complete sub-field containing the "exhausted" block and concentrating flock extraction only upon the sub-field in which both blocks still contain extractable fiber material. This elimination of the incomplete sub-field is effected even if the three-block variant which arises is one of those permitted when originally programmed by the user. The reason is that the operation of the flock delivery system will have been programmed by the user to give production rates of the two fiber sorts in an approximately predetermined relationship to each other. This relationship cannot be maintained when one block (only) out of the original four blocks is exhausted.

VARIATIONS

As indicated above, the block concept may be differently exploited by a machine differing from the UNIFLOC. For example, if the turret 12 is rotatable at any of the markers, than there is no need to discriminate between blocks on the ground of their position relative to the ends of the track. On the other hand, for safety reasons it will be desirable to prevent rotation of the turret so as to swing the arm across an "empty" block. Also, special restrictions may be necessary if the turret cannot be rotated through a full 360°, for example because of power supply cables. Certain modes of rotation of the turret will then be prohibited. Further restrictions may be built into the programming if the extraction arm 14 is not effectively reversible as discussed above.

In order to facilitate interpretation of various expressions used in the subsequent claims, further variants will now be described under sub-titles related to those expressions. As a preliminary to this description of variants, however, it is mentioned that the physical arrangements of the register MR (FIG. 7) and OR (FIG. 9) have been illustrated in a manner which relates them as closely as possible to the associated parts of other Figures, but which bears little relationship to reality. These registers are made up by storage cells in a suitable storage matrix accessible to the micro-computer. The actual physical relationship of the cells of the matrix selected to make up a given register is irrelevant to functioning of that register. Similarly, the "translation unit" T (FIG. 8) has been indicated as a special unit for purposes of description and illustration; in practice, this unit would be made up by the central processing unit (CPU not shown) of the microcomputer in association with suitable translation routines built into its software.

FIELD DEFINITION

In the illustrated embodiment, the field defining means is provided by the markers Pl to P5 together with the main register MR which is conditionable to determine whether a specific marker is inside or outside the selected field. As indicated in the description of FIG. 1 and 2, however, alternative bale group defining arrangements are already known and used, for example with flock extraction units which respond directly to fibre bales and do not rely upon balegroup defining markers. Essentially, the field-defining means is operable to determine a selected area of the bale lay out floor over which the control system can move the flock extracting means in a controlled manner so that flock extraction can occur. Special field markers, or a "distance travelled" counter, could be used for this purpose.

Normally it is sufficient to determine the maximum extent of movement of the carriage along the path (track) in order to define the field. The dimension(s) of the field in directions transverse to the path will be defined by the effective length of the flock extracting means transverse to the path. If that length is selectable (e.g. the flock extracting means is formed by selectively energisable sections) then a selector means for determining the effective extraction length also forms part of the field defining means.

BLOCK DEFINITION

The illustrated block defining means comprises the field defining means (since in this embodiment the field is merely the sum of the block zones) together with the block specifying means provided by the manually operable units BN (FIG. 8). The definition of a block may be considered to comprise two essential components—the location of the relevant block zone and the intended destination of the flocks. There is one optional component, namely the bale-group number. This number is also used in the given example to specify the block zone location by specifying its size relative to a predetermined array. In the given example, the "destination" is determined by the predetermined (fixed) relationship between each block and a respective receiving line. However, this is not essential, and destination may also have to be selectively defined.

However, the full block definition may not be required at all times. The location of the block zone is always required—the unit must know when it is about to enter an inhibited block. The flock destination is needed only after release of the block (lifting of an inhibition thereon). The components of the definition may therefore be determined separately and at different times.

Location of the zone could, be defined using special block markers (separate from the bale-group markers, where such markers are also used) suitably located relative to the track. Bale group number does not then form a component of the block definition.

The detail required to "specify" the blocks (in the given example—by entry of data at DI, FIG. 8) depends upon the capabilities of the flock extracting unit. Where the unit is capable of deriving required information itself, by direct sensing of predetermined characteristics of the field and bales thereon, the infeed of data by the user can be correspondingly reduced. For example, if the unit is capable of performing a "sensing pass" to determine for itself the number of balegroups in the field, then this information is not needed from the user.

If the unit can also respond to special "block markers" which can be detected upon the sensing pass, and the destination for flocks from each block is predetermined, then the user is not required to enter any data at all, but only to locate the block markers suitably relative to the track.

The constraint imposed by the predetermined array of blocks is not essential. Where this constraint is not imposed, it is not essential to require the sum of the blocks (zones) to cover the whole field. Additional freedom of choice may, however, bring significant added complication for both the user and system designer. Further, where the sum of the blocks does not cover the whole field, special arrangements will have to be made for areas within the field but outside the blocks since such areas will not be covered by the processing routine accessing devices associated with the blocks.

The blocks (and the field) could of course be defined relative to an "absolute" frame of reference (fixed relative to track 16) instead of the variable frame provided by the markers. However, such an absolute frame of reference is generally superfluous.

RELEASE/INHIBIT

The illustrated release/inhibit means comprises the manually operable release/inhibit units BR (FIG. 8), and the CPU of the computer with its associated translation programs which determine the set of instructions in register MR.

The control acting directly on the processing elements is such that a block is automatically released unless it is specifically inhibited i.e. the instructions in the OR cells automatically initiate processing routines when the unit enters the corresponding block. This is not essential. The cells of operations register OR could be conditioned in dependence upon release or inhibition of the relevant block. Alternatively, the S cells might be made variably conditionable and the OR register may then be superfluous.

If specific block markers are used to define a block, then different markers may be used for released and inhibited blocks.

The invention is not limited to any specific mode of action of the inhibition on the control system. The important point is that the control system is unable to apply one or more predetermined processing routines to the inhibited block. This can be achieved by preventing access to the block (as illustrated), preventing access to the routines or substituting others (safety routines), preventing access to the operating elements which perform the routines or in any other suitable manner.

RELATIONSHIP OF THE UNIT TO THE ZONES

One indication of this relationship is provided in the illustrated embodiment by the stepping counter SC1, side register SR and the associated direction and marker sensors. The indicator acts in conjunction with the main register which effectively provides a "picture" (record) of the field with its sub-divisions.

The arrangement shown in Fi. 7 could provide a position indication even where a radically different programming technique is used to define the blocks e.g. the sequence of decision steps at each marker as described in the text. The register MR would then be effectively reduced to a "position register" and the position indication would have to be compared with another record of the block configuration(s). However, current position (alone) could be indicated by a single cell e.g. stepping counter SC1, if specific positions can be allocated "addresses" storable in the current position cell.

A second indication of the relationship is provided in the arrangement of FIG. 9 by the line register LR and side register SR. This provides a more direct indication of the required relationship but is itself dependent upon information derived from the main register MR to indicate movement over a block divider. An equivalent indication can, however, be derived by a decision-making sequence even where a position indicator such as register MR is not used.

INTERCONNECTION WITH DOWNSTREAM LINE(S)

The micro-computer is programmed to issue signals to set the divertor 30 according to the currently effective block pair 31/33 or 32/34. If only one downstream line is to be supplied, then issue of signals by the microcomputer is superfluous. Clearly, more than two lines could be supplied—the instruction set must be arranged to cause issue of appropriate line identification signals by the computer. Where the arrangement of blocks is under the free control of the user and a plurality of lines is to be supplied, the user must specify the line to be associated with each block or otherwise indicate the required destinations.

STATES OF THE BLOCKS

The means for indicating the states of the blocks is provided in the illustrated embodiment by the operations register OR. Since a predetermined configuration (array) of blocks is defined, it is possible to define a set of corresponding cells to record the current states of the blocks. In the absence of a predetermined array, "state cells" must be associated with newly defined blocks by the computer.

Also, where there is a predetermined array, a special means can be provided to indicate the currently effective block. This means is represented in FIG. 9 by the line register LR and side register SR. Where there is no such predetermined array, an indication of the currently effective block can be obtained from the previously discussed means indicating the relationship between the unit and the block(s).

As previously mentioned, the state cells can be conditioned not only to indicate respective "release states" (as in the given example), but also to indicate whether the relevant block is released or inhibited. An "inhibited" condition may substitute "safety" programs for processing programs.

TURRET ROTATION

Turret rotation may be effected with the arm 14 in the uppermost position on the turret. The turret can then be turned with the arm passing over the bales in stretch S1. Alternatively, position P0 may be sufficiently far from position P1 to allow free space for turret station —this is unlikely to be acceptable to the user, however, as it demands a lot of floor space. In order to avoid the need to send the arm 14 to its uppermost position when the turret is rotated with the arm over the bales, the micro-computer may be programmed to perform the following steps:

(i) determine the height of the highest bale-group in the layout (using data in the bale-group register)

(ii) determine a "rotation height" for the arm equal to the height of the highest bale-group plus a predetermined safety margin (iii) move the arm to the rotation height before rotation of the turret is effected.

PROCESSING BOTH SIDES

In order to emphasise, however, that turret rotation is not essential to processing of a field on both sides of the carriage path, additional detail of a "double-armed" flock extraction unit is provided in FIGS. 10 (end elevation) and 11 (plan view).

A straight-line track defining means is indicated at 160. The track defining means is hollow and is divided by a longitudinal wall 162 into a "left hand" duct 164 and a "right hand" duct 166. At the "downstream" end (the end closer to the processing lines considered in the direction of transport of flock material) the ducts are connected to a diverter chamber 168 which feeds two transport ducts 170, 172 respectively. These feed respective processing lines. Chamber 168 can be operated to direct flock material from both ducts 164, 166 into one or other of ducts 170, 172, or to direct material from respective ducts 164, 166 into respective ducts 170, 172. The means for directing flocks from chamber 168 selectively to ducts 170, 172 (one example of which will be described below) can be controlled by signals from the micro-computer MC shown in FIG. 6.

One example of an arrangement for enabling selective delivery of flocks to lines 170, 172 is shown diagrammatically by the three slidably movable plates 171A, B and C in FIG. 11. Each is slidable in guides (not shown) in directions along the length of track 160.

Wall 162 stops short of the end of track 160. Plate 171A is slidable through a vertical slot in the end wall of the track. Plate 171A can be moved between an inserted position (not shown) in which it engages the end of wall 162 and a withdrawn position (illustrated) in which it closes the slot but does not project significantly into ducts 164, 166. In its inserted position, plate 171A separates ducts 166 and 170 from ducts 164 and 172. When plate 171A is in its withdrawn position, all four ducts (164, 166, 170 and 172) are in free communication with each other at their junction region.

Similarly, each of plates 171B and 171C has a withdrawn position (illustrated) in which it permits free communication between its associated duct 170, 172 and at least the adjacent track duct 166, 164 respectively. In their withdrawn positions, plates 171B and 171C close respective slots through which they can be individually moved to respective inserted positions. In the latter, plate 171B separates duct 170 from the interior of the track, and plate 171C separates duct 172 from the interior of the track.

Each duct 170, 172 can be connected to a respective fan downstream (considered in the material flow direction) from the track 160. When plate 171B or 171C is inserted to separate a duct 170, 172 from the track, the fan in that duct is preferably also de-energised.

A carrier 100 is adapted (by means not shown) to run along the track in the same way as carriage 10 in FIG. 1. Carrier 100 does not have a rotatable turret but extends to approximately the same height above floor 20 (FIG. 10) as the turret 12 in FIG. 1. Carrier 100 supports and guides two flock extracting arms 140, 142 which are vertically movable in the same way as arm 14 in FIG. 1.

A flock directing lead 144 is provided within carrier 100 to guide flocks extracted by arm 142 into duct 166. A second lead 146 directs flocks from arm 140 to duct 164. The details of these leads have not been shown—they can be similar to those currently used to direct flocks from arm 14 (FIG. 1) into the single duct in track 16 (FIG. 1). As shown in FIG. 10, arm 140 can process bales 130 on the left hand side of the track while arm 143 simultaneously processes bales 132 on the right hand side thereof (right and left designations arbitrary). There are a number of adavantages:

(a) as shown in FIG. 10, the arms can be disposed at different heights; thus bales at different "stages" can be processed—that is, assuming bales 130 and 132 are similar before flock extraction starts, arm 140 can be operating on fresh bales while arm 142 is processing half finished bales; this gives a much better fibre blend even if the fibres are of the same origin—they can however also be of different origins, giving earlier blending of the two fibre types, (b) fibres of different sorts can be fed simultaneously to two lines, (c) as a result of (b), the capacities of downstream buffer chambers in the processing lines can be reduced, (d) higher production rates can be achieved.

A double-armed flock extraction unit has already been disclosed in U.S. Pat. No. 3,443,285 and British Patent 1,431,365. In that case, however, the arms are provided with flock gripper units, rather than with spiked roller equipment of the type shown in U.S. Pat. No. 4,457,058. Accordingly, the prior unit British Patent 1,431,365 was not capable of feeding flocks simultaneously from both sides to a duct pair in the track defining means, nor of selective blending of the fibre flocks in the duct system.

BLOCK CONCEPT AND RELEASE CONCEPT

The illustrated example employs both these concepts and represents the preferred embodiment in providing this combination. The release/inhibit concept is however usable even if the field is not organised into blocks. For example, the release/inhibit concept could be applied at the bale group level; each "stretch" of the path would then correspond to an individual zone in which processing of the associated bale group could be selectively released or inhibited. In this case, selectively conditionable S cells could be used to indicate the current bale group and whether or not it is "released"; alternatively, the S cells could again act merely as position identifying cells and separate storage could be provided for data regarding release/inhibition, processing routines etc.

We claim:

1. A flock delivery system comprising a flock extracting unit adapted to move on a predetermined path, means to define a field in a predetermined relationship to the path, means operable to define blocks within the field, indicating means to indicate the relationship of said flock extracting unit to said defined blocks, and control means responsive to said indicating means to apply predetermined processing programs to said blocks individually.

2. A system as claimed in claim 1 wherein said control means is a microcomputer.

3. A system as claimed in claim 1 or 2 wherein the number of blocks is selectable from a predetermined maximum number thereof.

4. A system as claimed in any of claims 1 and 2 wherein the blocks are arranged in a predetermined array.

5. A flock delivery system comprising a flock extracting unit disposed for movement in a predetermined path;

at least one field disposed along said path for disposition of at least two blocks of fiber bales therein in series, a plurality of markers disposed along said path in alternating manner with said blocks to define each block within said field;

a detector on said unit for emitting a signal in response to sensing of a marker during movement of said unit thereby;

a control means connected to said flock extracting unit for operating said unit, said control means including a microcomputer having a plurality of storage cells, each respective cell corresponding to one of said markers and a stretch of said path between two markers, each said cell containing instructions for operating said unit in a respective predetermined manner; and a manually operable means to selectively permit or inhibit transmission of instructions from each respective cell to said unit for operation of said unit at a selected block.

6. A flock delivery system as claimed in claim 5 which further includes a pair of said fields disposed in parallel on opposite sides of said path.

7. A flock delivery system as claimed in claim 5 wherein said control means further includes an operation register containing a plurality of cells corresponding to the number of said blocks, each of said latter cells containing instructions indentifying the state of each block in response to a signal from a respective marker.

8. A flock delivery system comprising a flock extracting unit for moving in a predetermined path relative to a field containing at least two blocks of fiber bales for selectively extracting fiber flocks therefrom; and control means connected to said unit for selectively actuating said unit to remove fiber flocks from at least a selected one of said blocks and for selectively inhibiting said unit from removing fiber flocks from at least a selected one of said blocks.

9. A flock delivery system as set forth in claim 8 wherein said control means includes at least one marker along said path to indicate the position of said extracting unit relative to said blocks and conditionable means corresponding to each said block for selectively activating and inhibiting said extracting unit thereat.

10. A flock delivery system as set forth in claim 8 wherein said control means includes a plurality of markers along said path to indicate the position of said extracting unit relative to said blocks and a data storage register having a plurality of cells containing a processing program for activating said extracting unit at a selected block, each cell being conditionable to alternately activate and de-activate said extracting unit at a selected block.

11. A flock delivery system as set forth in claim 10 wherein said register has a plurality of cells corresponding to said markers.

12. A flock delivery system as set forth in claim 10 wherein said cells are conditioned to correspond to a predetermined array of said blocks.

13. A flock delivery system as set forth in claim 10 which further comprises means for delivering fiber flocks from each block to a selected one of at least a pair of fiber processing lines.

14. A flock delivery system as set forth in claim 8 wherein said field contains one row of said blocks on one side of said path and a second row of said blocks on an opposite side of said path, said extracting unit being operable to move along and over each row in sequence.

15. A flock delivery system as set forth in claim 1 wherein said control means includes a data infeed unit having a plurality of sub-units corresponding in number to the number of said blocks, each said sub-unit being arranged to permit an indication as to whether a respective block is "released" for flock extraction or "inhibited" from flock extraction.

16. A flock delivery system comprising a flock extracting unit adapted to move on a predetermined path;

means to define a field in a predetermined relationship to said path containing a plurality of zones for containing zones in at least some of said zones; and control means for applying predetermined processing programs to said bale groups individually, said control means including a data infeed unit having a plurality of sub-units corresponding to said zones, each said sub-unit being arranged to permit an indication as to whether a respective zone is "released" for flock extraction or "inhibited" from flock extraction.

17. A flock delivery system as set forth in claim 16 wherein said control means includes a microcomputer having a plurality of storage cells, each cell corresponding to a predetermined stretch of said path and containing instructions for operating said unit in a predetermined manner.

18. A flock delivery system comprising means to define a field containing a plurality of zones for containing bale groups;

a flock extracting unit for moving relative to said field for selectively extracting fiber flocks from selected bales; and control means connected to said unit for selectively actuating said unit to remove fiber flocks from at least a selected one of said zones and for selectively inhibiting said unit from removing fiber flocks from at least a selected one of said zones.

19. A flock delivery system comprising a flock extracting unit for moving in a predetermined path relative to a field having blocks defined therein;

indicating means for determining the relationship of said flock extracting unit relative to said defined blocks; and control means responsive to said indicating means for applying predetermined processing programs to said blocks individually in response to a determined relationship of said flock extracting unit to a defined block.

* * * * *

UNITED STATES PATENT AND TRADEMARK OFFICE

CERTIFICATE OF CORRECTION

PATENT NO. : 4,951,358

DATED : August 28, 1990

INVENTOR(S) : ROLF BINDER, et al

It is certified that error appears in the above-identified patent and that said Letters Patent is hereby corrected as shown below:

Column 2, line 14 change "respectively portions" to -respectively with portions"
Column 6, line 63 change "floor areas" to -(floor area)-
Column 11, line 13 change "flock" to -block-
Column 11, line 67 change "diagranmatically" to -diagrammatically-
Column 13, line 2 change "inhibbited" change -inhibited-
Column 14, line 11 change "block" to -block.-
Column 18, line 64 change "diaagonally" to -diagonally-
Column 21, line 61 change "Fi. 7" to -Fig. 7-
Column 26, line 28 change "zones" to -bale groups-
Column 26, line 30 change "bale groups" to -zone-

Signed and Sealed this

Third Day of March, 1992

*Attest:*

*Attesting Officer*

HARRY F. MANBECK, JR.

*Commissioner of Patents and Trademarks*